US006185965B1

(12) United States Patent
Lee

(10) Patent No.: US 6,185,965 B1
(45) Date of Patent: Feb. 13, 2001

(54) LOCKING DEVICE

(76) Inventor: Hong Kyun Lee, 1102 shinho-villate city, 452-3 Sungnae-dong, Seoul (KR)

( * ) Notice: Under 35 U.S.C. 154(b), the term of this patent shall be extended for 0 days.

(21) Appl. No.: 09/437,467

(22) Filed: Nov. 10, 1999

(30) Foreign Application Priority Data

Nov. 11, 1998 (KR) ..... 98-48128

(51) Int. Cl.[7] ..... E05B 21/00; E05B 25/02; E05B 25/06

(52) U.S. Cl. ..... 70/355; 70/377; 70/DIG. 24; 70/DIG. 52

(58) Field of Search ..... 70/349, 353–356, 70/377, 389, 392, DIG. 24, DIG. 52

(56) References Cited

U.S. PATENT DOCUMENTS

| | | | | |
|---|---|---|---|---|
| 1,177,360 | * | 3/1916 | Schoenfeld | 70/392 |
| 3,402,581 | * | 9/1968 | Schweizer et al. | 70/355 |
| 3,653,238 | * | 4/1972 | Brugemann | 70/377 X |
| 4,332,153 | * | 6/1982 | Miles | 70/335 X |
| 4,462,230 | * | 7/1984 | Evans | 70/355 X |
| 4,506,530 | * | 3/1985 | Robinson et al. | 70/355 X |
| 4,526,022 | * | 7/1985 | Parrock | 70/355 X |

FOREIGN PATENT DOCUMENTS

| | | | | |
|---|---|---|---|---|
| 418591 | * | 9/1925 | (DE) | 70/355 |
| 209231 | * | 3/1968 | (SU) | 70/355 |

* cited by examiner

*Primary Examiner*—Lloyd A. Gall
(74) *Attorney, Agent, or Firm*—Galgano & Burke

(57) ABSTRACT

Disclosed is a locking device including a slider arranged in a housing in such a fashion that it is slidable between a locking position thereof and a lock releasing position thereof, the slider having a bolt adapted to selectively lock an article to which the locking device is applied, a rotating member mounted in the housing in such a fashion that it is rotatable between a locking position thereof and a lock releasing position thereof while being always urged toward an initial position defined between the locking position thereof and the lock releasing position thereof, a cylinder mounted in the housing in such a fashion that it is rotatable between a locking position thereof and a lock releasing position thereof, the cylinder having an engagement rod adapted to selectively move the slider between the locking and lock releasing positions thereof, a plurality of key plates hingably mounted in the housing, the key plates respectively having guide channels which are misaligned from one another at an initial position of the key plates, a resilient strip member adapted to always urge the key plates toward the initial position thereof, and a pusher mounted in the housing in such a fashion that it rotates along with the rotating member, the pusher serving to rotate the cylinder between the locking and lock releasing positions thereof.

10 Claims, 6 Drawing Sheets

LOCKING DEVICE

BACKGROUND OF THE INVENTION

1. Field of the Invention

The present invention relates to a locking device, and more particularly to a locking device capable of securely maintaining a locking state thereof, as in a box type configuration, while eliminating a limitation on the application thereof, which is involved in the case of the box type configuration.

2. Description of the Prior Art

A locking device, which has a box type configuration, typically includes a plurality of key plates each having a key groove. The key plates are mounted in a stacked state in a housing of the locking device in such a fashion that they can be hinged by a rotation of a key while being resiliently urged by a resilient member. In accordance with the hinging of the key plates, the locking device is switched between its locking state and its lock releasing state.

In this locking device, an engagement member, which is operatively connected to the key plates, moves between its locking position and its lock releasing position by the rotation of the key. At the lock releasing position, the engagement member engages with grooves formed at the key plates, thereby causing the key plates to be held at fixed positions, respectively.

Since this locking device uses a large number of key plates, it can securely maintain its locking state. Accordingly, it is very difficult to release the locking state of the locking device using any means except for a designated key. However, there is a problem in that the key cannot be separated from the locking device at the lock releasing position because the key groove of the key is engaged with the key plates at the lock releasing position.

For this reason, the conventional box type locking device have been used only for locks of safes or similar devices.

Since the key cannot be separated from the locking device in the lock releasing state, such a box type locking device is used for a door lock installed at the gate of a building or other construction which is frequently opened.

SUMMARY OF THE INVENTION

Therefore, an object of the invention is to provide a locking device having a configuration capable of allowing separation of a key in a lock releasing state of the locking device while maintaining the advantages of the conventional box type locking device, so that it is applicable to any devices or constructions requiring a locking function.

In accordance with the present invention, this object is accomplished by providing a locking device comprising: a housing defined with a closed space therein and provided with an opening for opening the closed space; a cover mounted to the housing and adapted to close the space of the housing; a slider arranged in the housing in such a fashion that it is slidable between a locking position thereof and a lock releasing position thereof, the slider having a bolt adapted to selectively lock an article to which the locking device is applied; a rotating member mounted in the housing in such a fashion that it is rotatable between a locking position thereof and a lock releasing position thereof, the rotating member having a torsion spring adapted to always urge the rotating member toward an initial position defined between the locking position thereof and the lock releasing position thereof; a cylinder mounted in the housing in such a fashion that it is rotatable between a locking position thereof and a lock releasing position thereof, the cylinder having an engagement rod adapted to selectively move the slider between the locking and lock releasing positions thereof, the cylinder being connectable with an external connecting member; a plurality of key plates hingably mounted in the housing, the key plates respectively having guide channels which are misaligned from one another at an initial position of the key plates; a resilient strip member adapted to always urge the key plates toward the initial position thereof; and a pusher mounted in the housing in such a fashion that it rotates along with the rotating member, the pusher having a locking arm adapted to move the engagement rod toward the locking position of the cylinder, a lock releasing arm adapted to move the engagement rod toward the lock releasing position of the cylinder, and a swing member received in the guide channels of the key plates and allowed to move along the guide channels in a state in which the guide channels are aligned together.

BRIEF DESCRIPTION OF THE DRAWINGS

The above objects, and other features and advantages of the present invention will become more apparent after a reading of the following detailed description when taken in conjunction with the drawings, in which:

FIG. 2A and 2B illustrate an assembled state of the locking device according to the present invention, in which FIG. 2A is a plan view whereas FIG. 2B is a sectional view;

FIGS. 6A to 6C are views respectively illustrating a returning means included in the locking device, in which FIG. 6A is a sectional view whereas FIGS. 6B and 6C illustrate respective operations of the returning means in the locking and lock releasing positions of a rotating member included in the locking device.

DESCRIPTION OF THE PREFERRED EMBODIMENTS

Now, preferred embodiments of the present invention will be described in detail, in conjunction with the annexed drawings.

Figure 1:
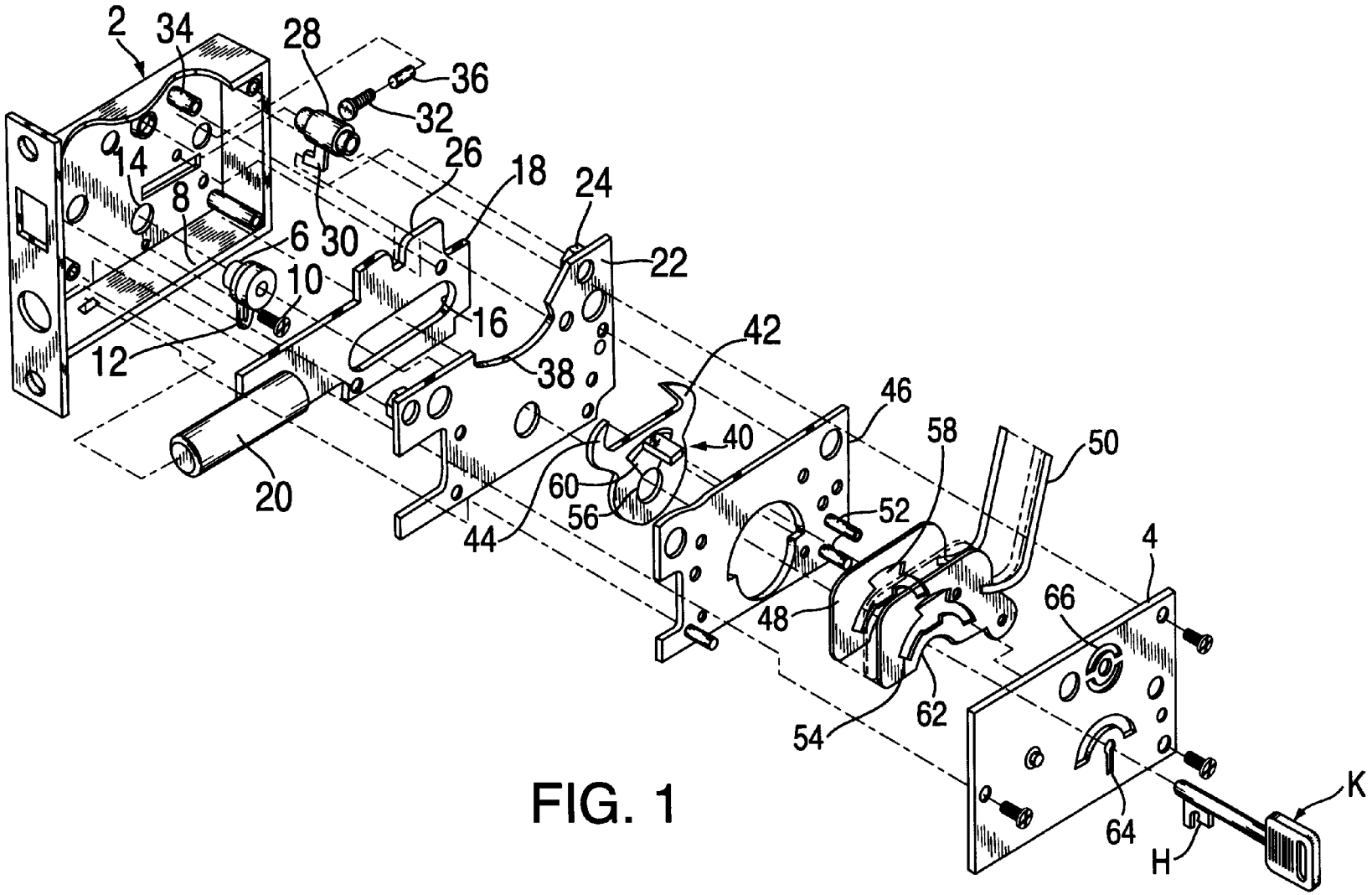
FIG. 1 is an exploded perspective view illustrating a locking device according to the present invention.

FIG. 1 is an exploded perspective view illustrating a locking device according to an embodiment of the present invention. In FIG. 1, the reference numeral 2 denotes a housing, and the reference numeral 4 denotes a cover for covering an opening of the housing 2. The housing 2 may have an optional size and an optional shape appropriately determined in accordance with the use purpose of the locking device. In accordance with the size and shape of the housing 2, the shape of the cover 4 may be appropriately determined.

A key returning means is mounted to a bottom wall of the housing 2 (the left wall of the housing 2 when viewed in FIG. 1). The key returning means serves to allow a key K, which is inserted in a key hole and then rotated from an initial key insertion position to a locking position or a lock releasing position, to return the initial insertion position for a separation thereof from the key hole.

Figure 6A:
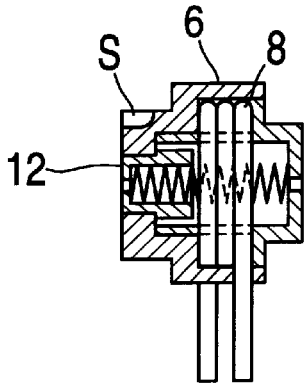
Figure 6B:
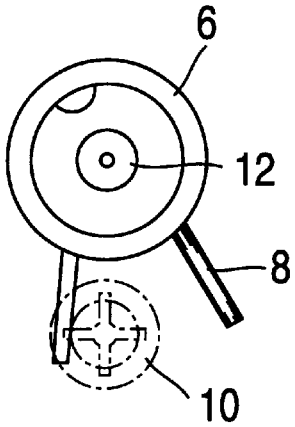
Figure 6C:
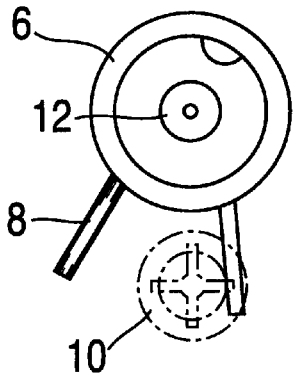

As shown in FIG. 1, 6A and 6B, the key returning means includes a rotating member 6, a torsion spring 8 circumferentially wound in the rotating member 6, and a stopper 10 for supporting both ends of the torsion spring 8.

The rotating member 6 has a central hole in which a resilient member 12 is resiliently installed by means of a compression coil spring S. When the key K is completely inserted into the key hole, its tip depresses the resilient member 12 against the compression coil spring S, so that it is inserted into the central hole of the rotating member 6. Accordingly, the key K can rotate about the central hole of the rotating member 6.

The rotating member 6 is fitted at its bottom portion in a hole 14 formed at the bottom wall of the housing 2 in such a fashion that it can rotate about the hole 14.

A slider 18 is laid on the bottom wall of the housing 2 in such a fashion that it is slidable along the bottom wall of the housing 2. The slider 18 has a longitudinally elongated narrow channel 16 in which the rotating member 6 is received. A bolt 20 is fixedly mounted to one longitudinal end of the slider 18 by means of a welding method or set screws. The bolt 20 is adapted to engage with a fixed frame of a door or similar fixed construction to which the locking device of the present invention is applied.

Figure 2B:
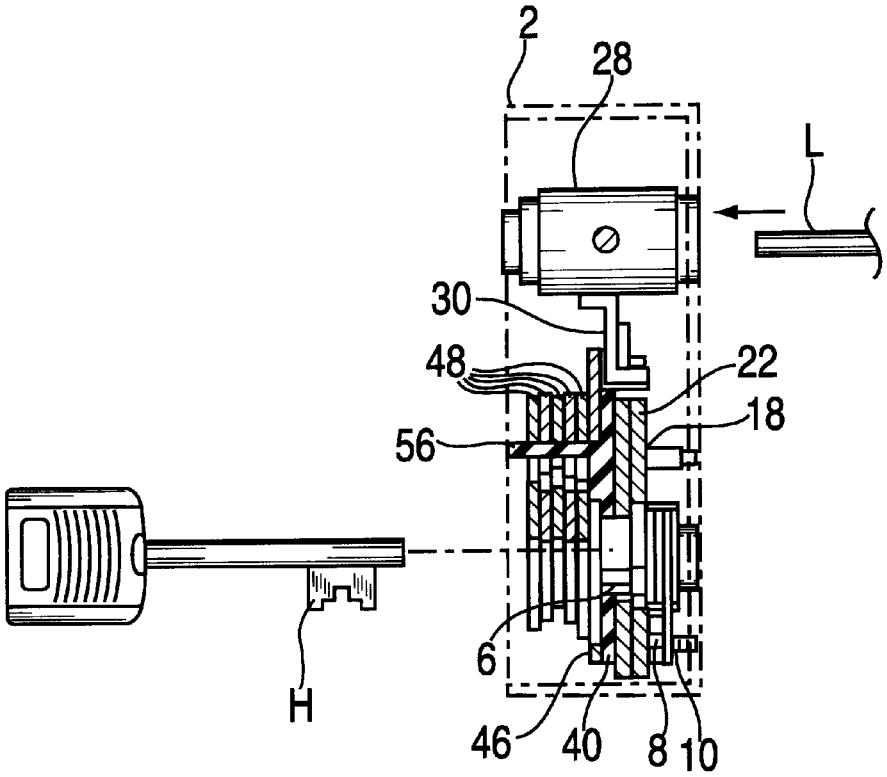
Figure 3A:
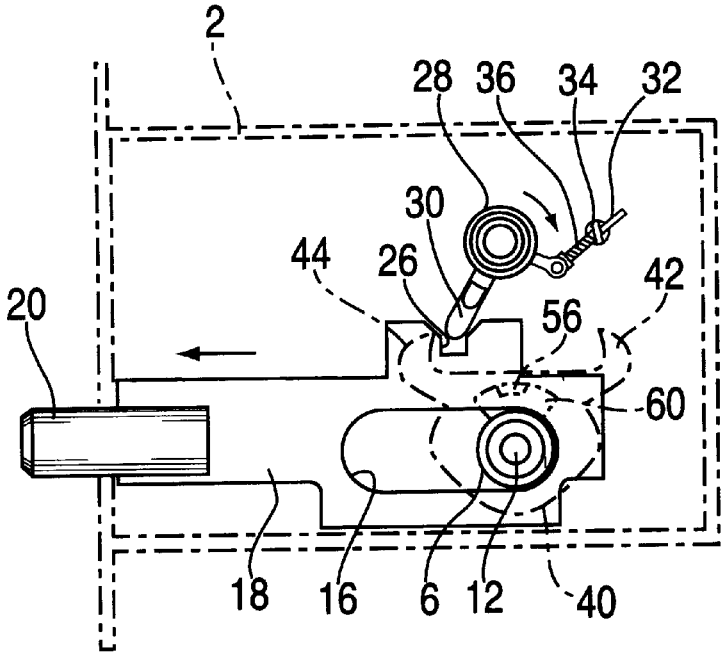
FIGS. 3A to 3C are schematic views respectively illustrating different operation states of the locking device according to the present invention, in which FIG. 3A corresponds to a locking state of the locking device, FIG. 3B corresponds to states of a key and key plates in the locking state of the locking device, and FIG. 3C corresponds to a lock releasing state of the locking device.
Figure 3B:
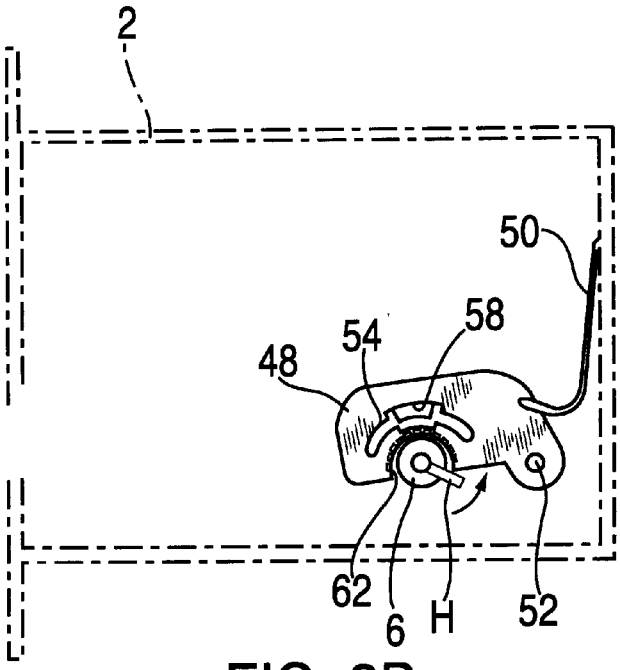
Figure 3C:
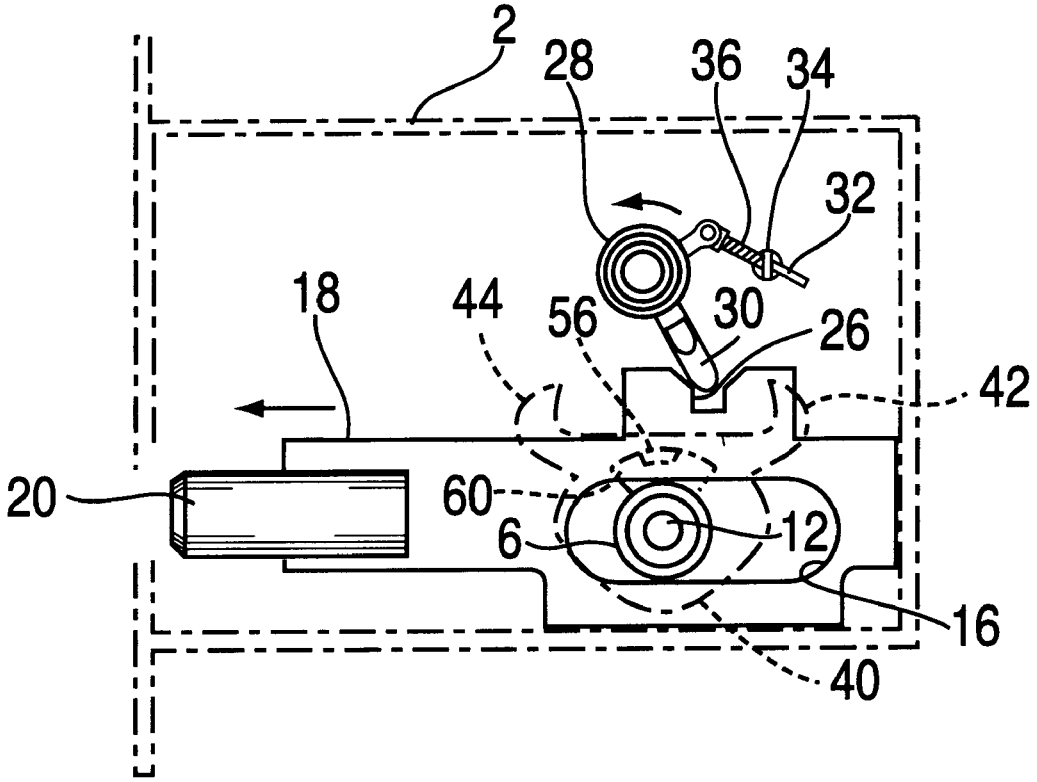

The channel 16 has a length sufficient to allow the bolt 20 to move to a locking position and a lock releasing position. The stroke of the slider 18 may be limited by the length of the channel 16 (FIGS. 2B and 3A).

A guide plate 22 is fixedly mounted to the bottom wall of the housing 2 while being upwardly spaced apart from the bottom wall of the housing 2 to allow the slider 18 to move slidably. The guide plate 22 guides the longitudinal sliding movement of the slider 18.

Spacers 24 are interposed between the bottom wall of the housing and the guide plate 22 in order to maintain a desired space between the bottom wall of the housing and the guide plate 22. Accordingly, the guide plate 22 does not interfere with the sliding movement of the slider 18.

The slider is also provided at one lateral end thereof with a groove 26 for receiving an engagement rod 30 included in a rotating cylinder 28 coupled to a general handle (not shown) installed on a door inside a room. Although not shown, the cylinder 28 has a connecting hole into which a key or other connecting member L may be inserted (FIG. 2).

When the cylinder 28 rotates, the slider 18 moves between its locking position and its lock releasing position in accordance with the rotating direction of the cylinder 28 because the engagement rod 30 of the cylinder 28 is engaged with the groove 26.

In order to ensure reliable rotating operations of the cylinder 28 between the locking and lock releasing positions, a restraining means is provided at the cylinder 28.

As shown in FIGS. 3A to 4B, the restraining means includes a lever 32 hingably coupled to the cylinder 28, a block 34 fitted around the lever 32 and adapted to allow the lever 32 to move slidably through the block 34 during the hinging operation thereof, and a compression coil spring 36 fitted around the lever 32 between the hinge of the lever 32 and the block 34 and adapted to apply a resilient force to both the hinge of the lever 32 and the block 34.

The guide plate 22 is provided at one lateral end thereof with a restraining groove 38 serving as a means for restraining the rotation of the engagement rod 30 to a desired range.

Preferably, the restraining groove 38 has an arc shape so that it does not interfere with the rotation of the engagement rod 30 carried out within a desired range. The engagement groove 26 should be arranged within a region where the restraining groove 38 extends, in order to allow the locking device to be manipulated inside the room for its switching between its locking state and its lock releasing state.

A pusher 40 is tightly fitted around the rotating member 6 in such a fashion that it rotates along with the rotating member 6. The pusher 40 is adapted to allow the locking device to be manipulated by the key K outside the room for its switching between its locking state and its lock releasing state.

In accordance with the present invention, the pusher 40 has a locking arm 42 selectively coming into contact with the engagement rod 30 at its tip, and a releasing arm 44 selectively coming into contact with the engagement rod 30 at its tip. Each of the locking and releasing arms 42 and 44 has a length sufficient to allow the associated arm to come into contact with the engagement rod 30.

The locking arm 42 and releasing arm 44 face each other. The pusher 40 is firmly fitted around the rotating member 6 in accordance with, for example, a conventional keyed coupling method so that it rotates along with the rotating member 6.

The reason why the rotating member 6 and pusher 40 are prepared using separate elements, respectively, in spite of the fact that they rotate together, is to achieve an easy assembly of the slider 18 and guide plate 22 to the rotating member positioned at the bottom wall of the housing 2. Accordingly, the rotating member 6 and pusher 40 may be integrally formed in so far as they allow an easy assembly of other elements.

A base plate 46 is fixedly mounted to the guide plate 22 in such a fashion that the pusher 40 is interposed therebetween. A plurality of key plates 48 are hingably coupled to the base plate 46 so that they hinge in accordance with a rotation of the key K.

Each of the key plates 48 is connected at one longitudinal end thereof to one end of a strip member 50 having a resilience. The other end of the strip member 50 is supported by a rear wall of the housing 2 so that the strip member 50 always urges the strip member 50 in a direction away from the rear wall of the housing 2.

The key plates 48 are arranged together in a stacked state and hingably coupled to a pin 52 protruded from the base plate 46. These key plates 48 have guide channels 54 having the same length, width, and shape, respectively.

A swing member 56 extends through the guide channels 54 of the key plates 48. The swing member 56 is provided at the pusher 40 in such a fashion that it rotates along with the pusher 40 when the pusher 40 rotates. The guide channels 54 have the same curvature as the swing trajectory of the swing member 56.

In order to allow the key K to be separated from the key hole even in the lock releasing state of the locking device while maintaining the lock releasing state, each guide channel 54 has an initial position groove 58.

The pusher 40 having the swing member 56 returns automatically to the initial key insertion position from the locking position or lock releasing position by virtue of the torsion spring 8 of the key returning means unless it is not subjected to a force from the key K. In the illustrated case, the pusher 40, which transmits a rotation of the K to the swing member 56, is integral with the swing member 56.

Each key plate 48 has an engagement groove 62 adapted to engage with the engagement groove H of the key K. In the engagement state with the engagement groove H of the key K, the engagement groove 62 receives a rotation force from the key K. Respective engagement grooves 62 of the key plates 48 have different radiuses or different curvatures corresponding to the topology of the engagement groove H of the key K. When the key K rotates after its insertion into the key hole, thereby causing the key plates 48 to hinge, the guide channels 54 of the key plates 48 are aligned together. In the aligned state of the guide channels 54, the swing member 56 of the pusher 40 is allowed to move along the aligned guide channels 54.

In FIG. 1, the reference numeral 64 denotes the key hole formed at the cover 4. The reference numeral 66 denotes a hole formed at the cover 4 and adapted to support the cylinder 28 while allowing a rotation of the cylinder 28.

Now, the operation of the locking device having the above mentioned configuration will be described.

Figure 2A:
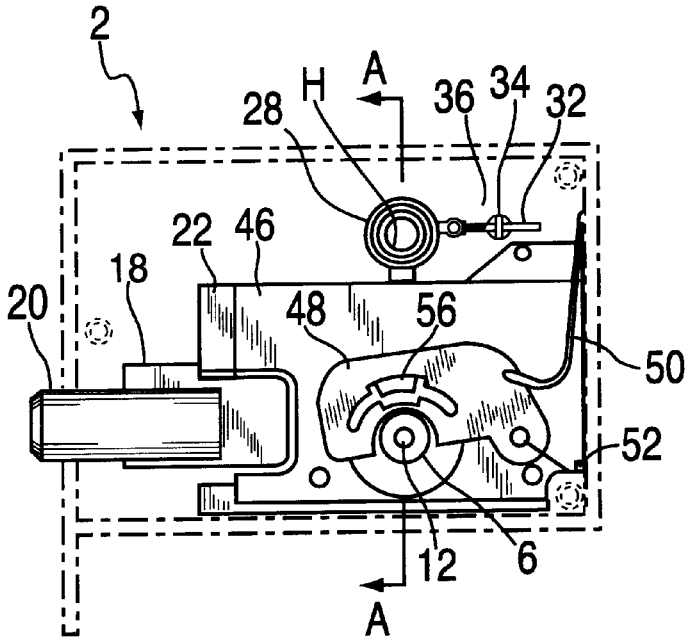

When the key K is inserted into the key hole 64 of the cover 4 in a state shown in FIG. 2A, it depresses the resilient member 12 at its tip. When the key K rotates in this state, the key K comes into contact with the engagement grooves 62 of the key plates 48 at its engagement groove H and then pushes the key plates 48 (FIG. 3A). The swing member 56 is urged by the key K to move along the guide channels 54 of the key plates 48. However, the swing member 56 cannot be allowed to move along the guide channels 54 because the guide channels 54 are in a state misaligned from one another.

As the key K pushes the key plates 48 at its engagement groove H, the key plates 48 hinge about the pin 52 because they are hingably coupled to the pin 52. At this time, the key plates 48 receives a resilient force in a direction opposite to the hinging direction thereof by virtue of the strip member 50.

When the engagement groove H of the key K comes into contact with the engagement grooves 62 of all key plates 48 as the key K rotates, the key plates 48 hinge from their positions where the guide channels 54 thereof are misaligned from one another to their positions where the guide channels 54 are aligned together. Thus, the guide channels 54 are aligned together.

In this state, the swing member 56 pushed by the key portion of the key K can move along the aligned guide channels 45. Accordingly, the pusher 40 rotates along with the rotating member 6.

At this time, the locking arm 42 pushes the engagement rod 30 of the cylinder 28 toward its locking position because it is in contact with the engagement rod 30.

Since the engagement rod 30 of the cylinder 28 is in a state engaged with the groove 26 of the slider 18, the movement of the locking arm 42 toward its locking position causes the slider 18 to slide toward its locking position. As a result, the bolt 20 fixedly mounted to the slider 18 moves toward its locking position, so that it engages with a fixed frame of a door or similar fixed construction, to which the locking device of the present invention is applied, thereby locking the door (FIG. 3A).

During the rotation of the pusher 40, the rotating member 6 also rotates, as mentioned above. When the rotating force applied to the key K is released, the rotating member 6 rotated to its locking position returns to its neural position by virtue of the torsion spring 8 applying a resilient force to the rotating member 6 (FIG. 6B).

When the rotating member 6 returns to its neural position, the pusher 40 fixed to the rotating member 6 also rotates in the same direction as the rotating member 6, so that it returns to its initial position. As the pusher 40 moves to its initial position, its swing member 56 pushes the key portion of the key K, thereby causing the key K to return to its initial position. At this time, the key plates 48 move to their initial positions, thereby causing the guide channels 54 to be misaligned again.

In this state, the key K can be separated from the key hole 64. At this time, the slider 18 is maintained at its locking position without returning to its lock releasing position. This is because the compression coil spring 36 applies its resilient force to the cylinder 28 in a direction toward the locking position. When the cylinder 28 rotates between its locking position shown in FIG. 3A and its lock releasing position shown in FIG. 3C, it passes a dead point where the compression coil spring 36 is in a maximum compressed state, as shown in FIG. 2A. When the cylinder 28 further rotates from the dead point, the compression coil spring 36 urges the cylinder 28 in a direction corresponding to the rotating direction of the cylinder 28. Accordingly, the cylinder 28 can be maintained at its locking or lock releasing position after its rotation by virtue of the resilient force of the compression coil spring 36 effecting in the same direction as the rotation of the cylinder 28 unless it is pushed against the resilient force of the compression coil spring 36 by the lock releasing arm 44 or locking arm 42 of the pusher 40 in an opposite direction. That is, the compression coil spring 36 serves to restrain an anti-clockwise rotation of the cylinder 28 in the state of FIG. 3A where the cylinder is at its locking position while restraining a clockwise rotation of the cylinder 28 in the state of FIG. 3C.

On the other hand, when the key K rotates to move the bolt 20 from its locking position to its lock releasing position, the engagement groove H of the key K comes into contact with the engagement grooves 62 of all key plates 48, thereby causing the key plates 48 to hinge from their positions where the guide channels 54 thereof are misaligned from one another to their positions where the guide channels 54 are aligned together. Thus, the guide channels 54 are aligned together, so that the key K is allowed to rotate.

As the key K rotates, the swing member 56 pushed by the key portion of the key K moves along the aligned guide channels 54. Accordingly, the pusher 40 rotates along with the rotating member 6. At this time, the lock releasing arm 44 pushes the engagement rod 30 of the cylinder 28, thereby causing the cylinder 28 to rotate toward its lock releasing position.

Figure 4A:
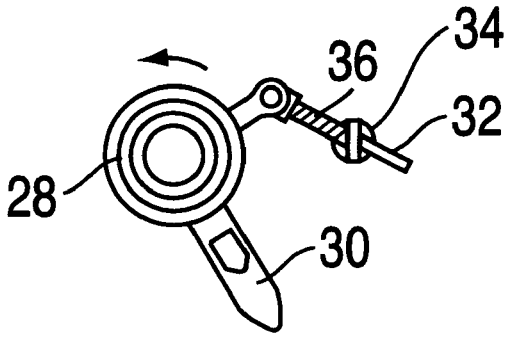
FIGS. 4A and 4B are schematic views respectively illustrating operations for restraining rotation of a cylinder included in the locking device in accordance with the rotation direction of the cylinder.
Figure 4B:
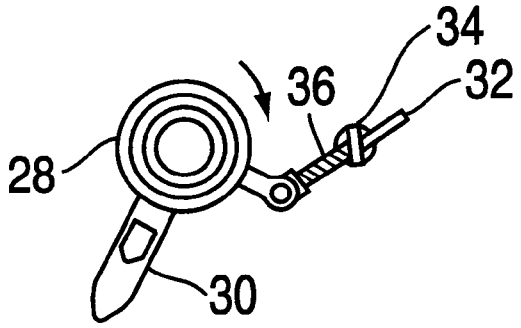
Figure 5:
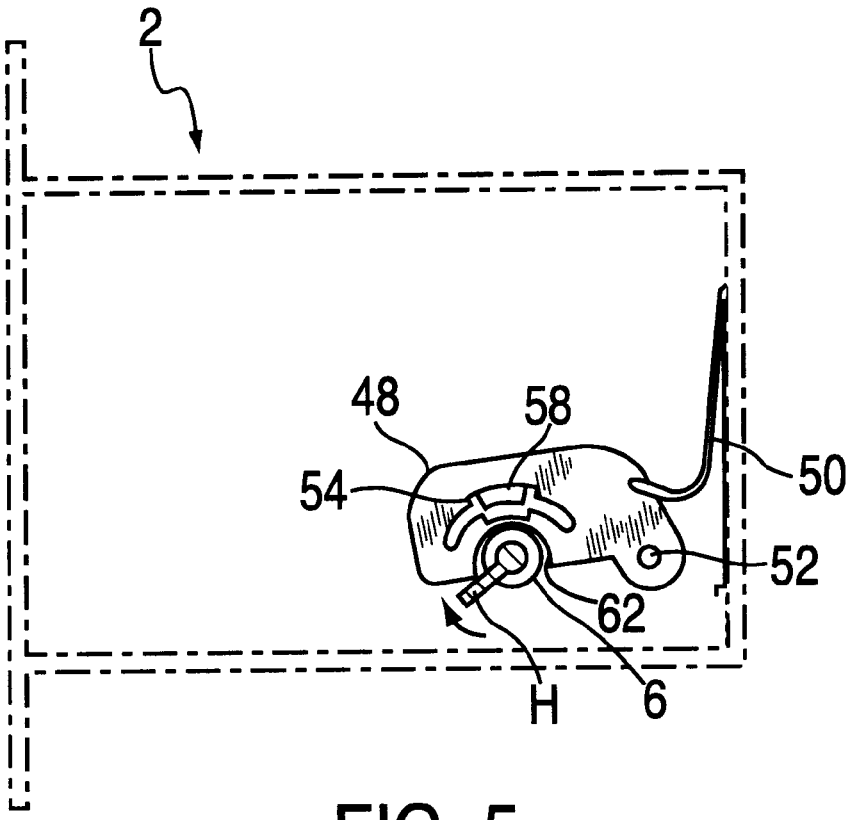
FIG. 5 is a view illustrating states of the key and key plates in the lock releasing state of the locking device.

As the cylinder 28 rotates toward its lock releasing position, the lever 32 hinges from the state of FIG. 4B to the state of FIG. 4A. Also, the slider 18 moves to its lock releasing position by the engagement rod 30 of the cylinder 28.

When the rotating force applied to the key K is released, the pusher 40 returns to its initial position by virtue of a resilient force generated from the torsion spring 8 of the rotating member 6. Simultaneously, the swing member 56 returns to its initial position along the aligned guide channels 54 of the key plates 48.

As the pusher 40 moves to its initial position, its swing member 56 pushes the key portion of the key K, thereby causing the key K to return to its initial position. Accordingly, the key K can be separated from the key hole 64.

As mentioned above, in the locking device having the above mentioned configuration according to the present invention, it is possible to move the slider 18 to both the locking position and lock releasing position not only by corresponding rotations of the key K, but also by corresponding rotations of the cylinder 28. Accordingly, the locking device of the present invention can be applied to a door.

As apparent from the above description, the present invention provides a locking device capable of eliminating functional and structural problems involved in a conventional box type locking device in that the key cannot be separated from the conventional locking device at its lock releasing position. Accordingly, the application of the locking device is not limited.

Although the conventional box type locking device can only be used for safes or the like, the locking device of the present invention can be applied to any devices requiring a locking function. For example, the locking device of the present invention can be applied not only to safes or the like, but also to doors installed at gates of buildings or other constructions, and key boxes of elevators.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A locking device comprising:

a housing defined with a closed space therein and provided with an opening for opening the closed space;

a cover mounted to the housing and adapted to close the space of the housing;

a slider arranged in the housing in such a fashion that it is slidable between a locking position thereof and a lock releasing position thereof, the slider having a bolt adapted to selectively lock an article to which the locking device is applied;

a rotating member mounted in the housing in such a fashion that it is rotatable between a locking position thereof and a lock releasing position thereof, the rotating member having a torsion spring adapted to always urge the rotating member toward an initial position defined between the locking position thereof and the lock releasing position thereof;

a cylinder mounted in the housing in such a fashion that it is rotatable between a locking position thereof and a lock releasing position thereof, the cylinder having an engagement rod adapted to selectively move the slider between the locking and lock releasing positions thereof, the cylinder being connectable with an external connecting member;

a plurality of key plates hingably mounted in the housing, the key plates respectively having guide channels which are misaligned from one another at an initial position of the key plates;

a resilient strip member adapted to always urge the key plates toward the initial position thereof; and a pusher mounted in the housing in such a fashion that it rotates along with the rotating member, the pusher having a locking arm adapted to move the engagement rod toward the locking position of the cylinder, a lock releasing arm adapted to move the engagement rod toward the lock releasing position of the cylinder, and a swing member received in the guide channels of the key plates and allowed to move along the guide channels in a state in which the guide channels are aligned together.

2. The locking device in accordance with claim 1, wherein the slider further has an engagement groove adapted to engage with the engagement rod.

3. The locking device in accordance with claim 1, wherein the rotating member and the pusher are key-coupled so that they rotate together.

4. The locking device in accordance with claim 1, wherein the cylinder further has a lever hingably mounted between the cylinder and the housing, and a spring adapted to always urge the lever toward in a direction corresponding to a rotation direction of the cylinder causing the cylinder to rotate to the locking or lock releasing position thereof, whereby the cylinder is maintained at the locking or lock releasing position thereof after the rotation thereof to the locking or lock releasing position.

5. The locking device in accordance with claim 1, wherein the guide channels of the key plates have different shapes, respectively.

6. The locking device in accordance with claim 1, wherein each of the guide channels has an initial position groove allowing the swing member of the pusher to be received in the guide channel at an initial position thereof.

7. The locking device in accordance with claim 1, further comprising a base plate fixedly mounted to the housing and adapted to support the key plates, the base plate being arranged in such a fashion that the slider is interposed between a bottom wall of the housing and the base plate.

8. The locking device in accordance with claim 1, wherein the swing member of the pusher receives a rotating force from the key.

9. The locking device in accordance with claim 1, wherein the rotating member has a central hole in which a resilient member is received in such a fashion that it is depressed by a tip of a key so that the central hole receives the tip of the key.

10. The locking device in accordance with claim 4, wherein the lever extends through a block fixedly mounted to the housing in such a fashion that it is slidable through the block during the rotation of the cylinder.

* * * * *